US007249762B1

(12) United States Patent
Bakker et al.

(10) Patent No.: US 7,249,762 B1
(45) Date of Patent: Jul. 31, 2007

(54) SYSTEM FOR FEEDING AND TRANSPORTING DOCUMENTS

(75) Inventors: Johan P. Bakker, Brighton, MI (US); J. Michael Spall, Commerce, MI (US); David Brian Tratar, Dearborn, MI (US)

(73) Assignee: Unisys Corporation, Blue Bell, PA (US)

( * ) Notice: Subject to any disclaimer, the term of this patent is extended or adjusted under 35 U.S.C. 154(b) by 295 days.

(21) Appl. No.: 10/855,189

(22) Filed: May 27, 2004

(51) Int. Cl.
*B65H 3/62* (2006.01)

(52) U.S. Cl. ..... 271/146; 271/147; 271/149

(58) Field of Classification Search ..... 271/146, 271/149, 2, 147, 129
See application file for complete search history.

(56) References Cited

U.S. PATENT DOCUMENTS 4,757,985 A * 7/1988 Hamant et al. ..... 271/31.1
4,789,148 A * 12/1988 Noguchi et al. ..... 271/94
5,419,546 A 5/1995 Chen et al.
5,437,375 A 8/1995 Chen et al.
5,439,506 A 8/1995 Chen et al.
5,509,648 A 4/1996 Chen et al.
5,671,919 A 9/1997 Chen et al.
5,848,784 A 12/1998 Tranquilla
5,908,191 A 6/1999 Chen et al.
6,199,854 B1 3/2001 Tranquilla et al.
6,260,841 B1 7/2001 Tranquilla
6,315,286 B1 * 11/2001 Muenchinger et al. ..... 271/146
6,417,221 B1 7/2002 Meltzer et al.
6,419,221 B1 * 7/2002 Spall ..... 271/31.1
6,425,579 B1 * 7/2002 Andreyka et al. ..... 271/147
6,474,637 B1 11/2002 Spall et al.
6,585,249 B1 * 7/2003 Andreyka et al. ..... 271/2
6,869,072 B2 * 3/2005 Andersson ..... 271/149

FOREIGN PATENT DOCUMENTS

JP 60178137 A * 9/1985

* cited by examiner

*Primary Examiner*—Patrick Mackey
*Assistant Examiner*—Kaitlin S Joerger
(74) *Attorney, Agent, or Firm*—Richard J. Gregson; Brooks Kushman P.C.

(57) ABSTRACT

A system for feeding and transporting documents includes a feeder stage and a transport stage. The feeder stage includes a feeder and a hopper assembly. The hopper floor carries the document stack, and includes a flag providing a force to move the documents along the hopper floor toward the feeder and to feed a document with a presentation force. A vibration source means vibrate the hopper floor such that the hopper floor vibration is stronger at the far end and weaker at the near end to cause a dynamic weight of the document stack to be reduced through vibration, particularly at the hopper floor far end when the document stack is large so as to reduce variation in the presentation force at the feeder.

6 Claims, 2 Drawing Sheets

SYSTEM FOR FEEDING AND TRANSPORTING DOCUMENTS

BACKGROUND OF THE INVENTION

1. Field of the Invention

The invention relates to systems for feeding and transporting documents and to document hoppers used in these systems.

2. Background Art

A typical system for feeding and transporting documents includes a feeder in the document feeding portion of the system, and a series of roller pairs or belts in the document transporting portion of the system. In the feeding portion of the system, the feeder acts to separate and feed documents singly, in order, from a stack. In the transporting portion of the system, the roller pairs and/or belts convey the documents, one at a time, past other processing devices such as readers, printers, and sorters that perform operations on the documents. The feeder is typically a feed wheel, but may take other forms. Further, the components in the transporting portion of the system may take a variety of forms. An existing document feeder is shown in U.S. Pat. No. 6,199,854. That patent describes a document feeder with a variable speed separator.

In existing systems for feeding and transporting documents, operations that depend on the position of the document are generally performed in the transport stage, or transporting portion of the system. For example, U.S. Pat. No. 5,848,784 describes a document separation apparatus. That patent describes the downstream acceleration/deceleration of documents with pinch rollers to adjust document spacing. U.S. Pat. Nos. 5,419,546; 5,437,375; 5,439,506; 5,509,648; 5,671,919; and 5,908,191 describe examples of other document operations.

As modern document handling devices are typically fitted with an automatic feeder mechanism to singly introduce documents into a track for further processing, a hopper is usually associated with the feeder so that the machine can load a number of documents to be processed. As feed rates increase, and feed mechanism reliability improves, there are advantages to making hopper capacity larger.

The difficulty with making hopper capacity larger is one of consistency. Document feeders need to have a supply of documents presented to the feeding mechanism in a consistent manner. This is a task of the document hopper. The variety of documents used in different applications make such consistent presentation difficult.

There is an ideal set of forces for feeding a document in a given feeder. The closer each document can be to this ideal set of forces, the better feeder performance will be. More specifically, the feeder must apply enough pinch force to allow the document to feed, but not so much as to result in the tearing apart of the document during feeding. As hopper capacity is increased, the variation in force against the stack between that needed to move a full hopper of documents and that needed to move the last few documents and provide an acceptable force to the document being fed is increased.

Typically, some form of mechanical intervention urges the document stack along in the hopper but the mechanical intervention may not compensate as the document stack diminishes. For a large capacity hopper, it is possible that the mechanical intervention may result in correct pinch force when the hopper is full, but too much pinch force when the hopper nears empty, or that the mechanical intervention may result in correct pinch force when the hopper is near empty, but too little pinch force when the hopper is full.

An existing form of mechanical intervention used to urge the document stack along in the hopper toward the feeding mechanism applies a generally constant force to the document stack with a flag. This form of mechanical intervention may limit the hopper capacity because the applied force to the stack must result in acceptable forces on a feeding document when moving a full hopper of documents and when moving the last few documents. Various approaches have been taken for driving the flag to produce the flag force or flag weight against the document stack.

Additional background information may be found in U.S. Pat. Nos. 6,474,637; 6,417,221; and 6,260,841.

The horizontal force with which the documents are presented to the feeder, F, is a function of the flag force, $F_f$, the weight of the document stack, W, and the friction coefficient of the document against the hopper floor, μ:

$$F=F_f-W\cdot\mu$$

The weight of the document stack is a summation of the weight of each document in the stack. As the hopper gets larger, the document stack can get larger. As the document stack gets larger, the weight difference between a stack of large documents and a stack of small documents grows. For proper feeder operation, the horizontal force with which documents are presented to the feeder, F, needs to fall within a range. The range for each feeder is determined by several factors including geometry and friction element effectiveness. For a given feeder, the range is essentially fixed. So the large hopper needs to be designed to carefully control the horizontal presentation force, F, despite increasing variations due to large hopper size.

Although various approaches have been taken to controlling the flag force, $F_f$, there has been no practical way to know the weight of the documents that had been loaded. Flag force can be tailored to some middle ground, but it cannot react to each document. As a result, it becomes difficult to keep the horizontal presentation force, F, within the optimal range.

Controlling the friction coefficient of documents against the hopper floor is one approach to controlling the variation in horizontal presentation force. However, this approach does have shortcomings. For example, very low friction materials can be delicate, low friction properties tend to degrade with wear, documents are loaded into the hopper with some violence, friction coefficient varies with humidity, and friction coefficient versus paper is largely unknown. Therefore, controlling variation with an approach that attempts to directly maintain a very low friction coefficient is not always reliable.

For the foregoing reasons, there is a need for an improved system for feeding and transporting documents that urges the document stack along in the hopper in a way that provides a consistent presentation of documents to the feeder.

SUMMARY OF THE INVENTION

It is, therefore, an object of the invention to provide an improved system for feeding and transporting documents that urges the stack of documents in the hopper toward the feeder in a way that provides consistent presentation of documents to the feeder while addressing presentation force variation with an approach that reduces the dynamic weight of the document stack through a controlled vibration.

In carrying out the invention, a system for feeding and transporting documents is provided. Each document has a leading edge and a trailing edge. The system comprises a feeder stage and a transport stage. The feeder stage includes a hopper assembly and a feeder. The feeder acts to feed documents singly, in order, from a stack of documents provided by the hopper assembly. The hopper assembly includes a hopper floor that carries the stack of documents, and a flag that provides a horizontal force to move documents along the hopper floor toward the feeder. The transport page is downstream of the feeder stage for receiving the fed documents.

The weight of the document stack may vary by a factor of three to one based on the documents loaded. The invention reduces the effects of this type of variation by reducing the dynamic weight of the document stack through vibration. For the fraction of a second that documents are bounced in the air, they are effectively weightless and their friction against the hopper floor is zero. Thus, the flag force can present the document stack to the feeder without having to overcome document friction against the hopper floor for the effectively weightless documents.

The system for feeding and transporting documents further comprises a vibration source means for vibrating the hopper floor in a way that takes advantage of vibratory feed theory. According to vibratory feed theory as applied in this system, the vibration source means and hopper floor are arranged such that the hopper floor vibration is stronger at the far end and weaker at the near end, near the feeder. In this way, the dynamic weight of the document stack is reduced through vibration, particularly at the far end with larger stacks. It is appreciated that this is a controlled vibration applied in a specific way.

Put another way, the arrangement controls the horizontal presentation force at the feeder despite increasing variations due to larger hopper size by applying vibratory feeder theory to a document feeder and hopper. The required stronger vibration at the far end and weaker vibration at the feeder may be achieved in any suitable way.

In a preferred approach to implementing an embodiment of the invention, the hopper floor includes vibrating rails that are fixed at the feeder end to create the required vibratory feed action, that is, to achieve the desired controlled vibration. It is preferred that the vibrating rails are narrow to reduce the moving mass. This reduces power requirements and vibration input to the stationary parts of the machine. Further, the narrow rails move less air while vibrating, producing less acoustical noise.

Further in the preferred implementation, the vibrating rails are stiff enough to avoid secondary deflections. Because the rails are narrow, they can be relatively deep without undue weight penalty. Since beam stiffness varies as the cube of depth, the rails are thus stiff and vibrate in one mode only.

Still further in the preferred implementation, the vibrating rails can be made in one piece. A vibrating member is subject to a violent environment. The design of the rail assembly lends itself to near net shape extrusion. Such an extrusion would be an economical means of producing the required function. Further, a one-piece rail extrusion could not come apart.

It is appreciated that the vibration source means may take any suitable form. For example, a solenoid drive is preferred. But mechanical arrangements are also contemplated. Any vibration source may be used so long as the resulting vibration is stronger at the far end and weaker at the near end to result in the desired effects on dynamic weight distribution. In addition, the resulting vibration is most likely to be achieved by placing the vibratory source at the far end. But, it would also be within the concepts of the invention to place the vibratory source at a different location and use appropriate damping to result in a vibration that takes advantage of vibratory feed theory and has the desired effects on dynamic weight distribution.

Advantageously, embodiments of the invention provide a system and a method that facilitates feeding documents from a large hopper by vibrating the documents, and that is robust, inexpensive, and comparable in performance to machines with smaller hoppers.

DETAILED DESCRIPTION OF THE PREFERRED EMBODIMENT

Figure 1:
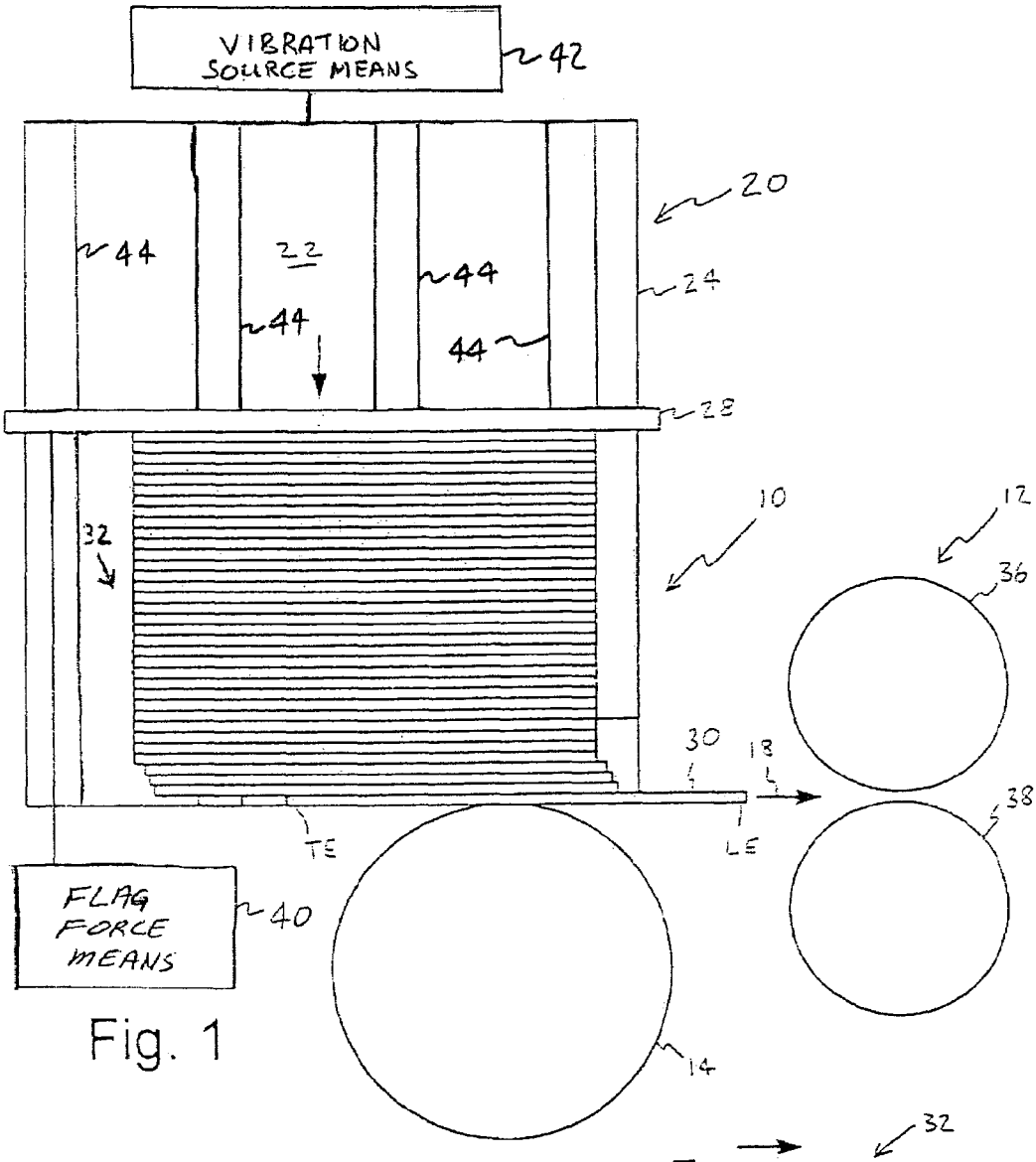
FIG. 1 is a plan view illustrating an exemplary system for feeding and transporting documents in accordance with the invention.
Figure 2:
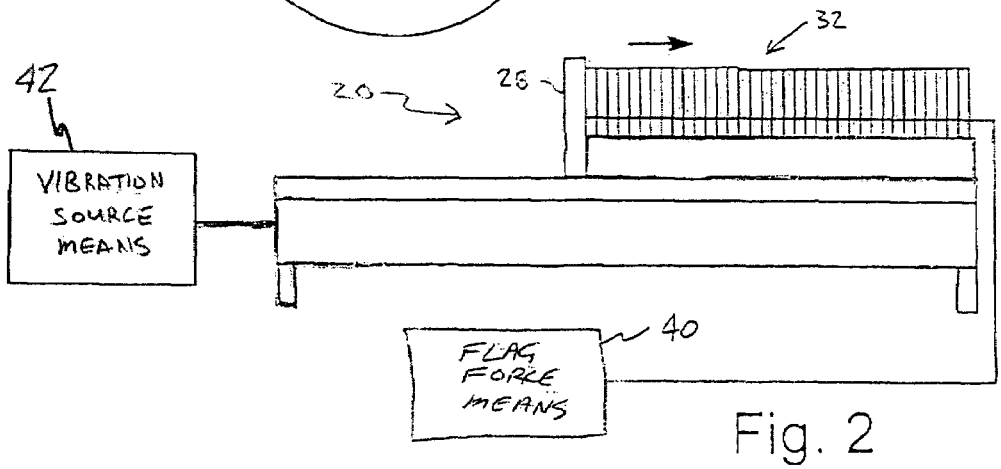
FIG. 2 is a side view showing the hopper assembly and the use of the flag force means and vibration source means to urge the stack of documents in the hopper assembly toward the feeder.

FIG. 1 illustrates a system for feeding and transporting documents. The system includes a feeder stage 10 and a transport stage 12. The feeder stage 10 includes a feeder 14. Transport stage 12 is downstream of feeder stage 10, with arrow 18 pointing in the downstream direction. A document leading edge LE is the more downstream edge, while the trailing edge TE is the more upstream edge. Feeder stage 10 includes hopper assembly 20. Hopper assembly 20 includes a hopper floor 22 and hopper sidewall 24. Hopper assembly 20 further includes document stack supporter or flag 28. A stack 32 of documents engages hopper floor 22. FIG. 2 shows hopper assembly 20 from the side.

With continuing reference to FIGS. 1 and 2, document stack 32 is shown adjacent to hopper sidewall 24 and includes first document 30 among other documents in stack 32, with the trailing edge TE of first document 30 still in hopper assembly 20. The components shown in FIGS. 1 and 2 are exemplary and alternative arrangements are possible as known to those skilled in the art. For example, the feeder is shown as a feed wheel 14, but may take other forms. As shown, feed wheel 14 rotates clockwise, driven by its own motor (not shown). Further, the components in the transporting portion 12 may take a variety of forms as known to those skilled in the art, but for convenience of understanding are shown as an accelerator idler wheel 36 and an accelerator drive wheel 38 that rotates clockwise.

Feed wheel 14 is a typical element for feeding documents singly from a document stack. The downstream accelerator wheel pair 36, 38 accepts the document from feed wheel 14. The accelerator drive wheel 38 may or may not be driven by the same motor that drives feed wheel 14 and may run at the same or higher speed than feed wheel 14. Further, feed wheel 14 may or may not have a greater grip on the document than the accelerator wheel pair, depending upon the application. Feed wheel 14 may or may not have attached to it a device to indicate relative feed wheel position.

Flag 28 provides a force to move document stack 32 along hopper floor 22 toward feed wheel 14. Flag 28 is biased to urge document stack 32 toward the feeder by flag force means indicated at block 40, which may take any suitable form such as a string or cable connected to a flag weight and/or spring.

Hopper floor 22 is composed of a set of rails 44. As vibration source means 42 vibrates vertically, rails 44 vibrate stronger at the far end and weaker at the near end (at feed wheel 14) to cause a dynamic weight of document stack 32 to be reduced through vibration, particularly at the hopper floor far end when the document stack is large. This reduces variation in the presentation force at feed wheel 14 because friction effects are reduced.

Reducing the dynamic weight of the document stack 32 reduces the effects of stack weight variation on the presentation force. For the fraction of a second that documents are bounced in the air, they are effectively weightless and their friction against the hopper floor 22 is zero. Thus, the flag force can present the document stack 32 to the feeder 14 without having to overcome document friction against the hopper floor 22 for the effectively weightless documents. In this way, vibration source means 42, in accordance with vibratory feed theory, reduces the dynamic weight of the document stack through a controlled vibration applied in a specific way.

Figure 3:
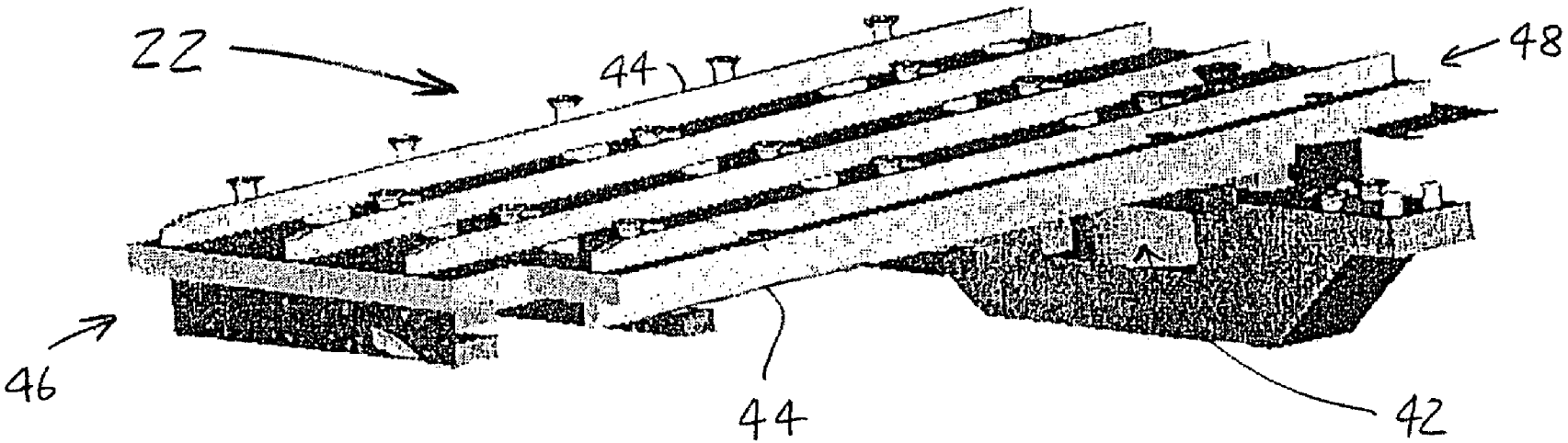
FIG. 3 is an enlarged perspective view of the hopper assembly and vibration source means in the preferred embodiment.

FIG. 3 illustrates a preferred implementation of the hopper assembly with hopper floor 22 composed of rails 44. The near end of hopper floor 22 is indicated at 46, while the far end of hopper floor 22 is indicated at 48. Vibration source means 42 is shown as a solenoid driver. Vibrating rails 44 are fixed at feeder end 46 to create the required vibratory feed action. Vibrating rails 44 are narrow to reduce the moving mass. This reduces power requirements and vibration input to the stationary parts of the machine. Further, narrower rails move less air while vibrating, and produce less acoustical noise.

Vibrating rails 44 are stiff enough to avoid secondary deflections. Because the rails 44 are narrow, they can be relatively deep without undue weight penalty. Since beam stiffness varies as the cube of depth, rails 44 are thus stiff and vibrate in one mode only.

Vibrating rails 44 can be made in one piece. A vibrating member is subject to a violent environment. The design of the rail assembly lends itself to near net shape extrusion. Such an extrusion would be an economical means of producing the required function. Further, a one piece rail extrusion could not come apart.

Although shown as a solenoid drive, vibration source 42 may take any suitable form with the important aspect being that the resulting vibration is stronger at the far end and weaker at the near end to result in the desired effects on dynamic weight distribution.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A system for feeding and transporting documents, each document having a leading edge and a trailing edge, the system comprising:

a feeder stage including a hopper assembly and a feeder wherein the feeder acts to feed documents singly, in order, from a stack of documents in the hopper assembly, the hopper assembly including a hopper floor having a near end at the feeder and a far end away from the feeder, the hopper floor carrying the document stack, and the hopper assembly further including a flag providing a force to move the documents along the hopper floor toward the feeder and to feed a document with a presentation force, wherein the force provided by the flag urges the document stack in a direction from the hopper floor far end toward the hopper floor near end;

a vibration source means for vibrating the hopper floor such that hopper floor vibration is stronger at the far end with the hopper floor vibration diminishing along the direction from the hopper floor far end toward the hopper floor near end such that the vibration is weaker at the near end to cause a dynamic weight of the document stack to be reduced through vibration, particularly at the hopper floor far end when the document stack is large, so as to reduce variation in the presentation force at the feeder;

a transport stage downstream of the feeder stage for receiving the fed documents;

wherein the hopper floor is composed of a set of rails that are sufficiently stiff so as to vibrate in only one bending mode.

2. The system of claim 1 wherein the rails are integrated as a single vibrating member.

3. The system of claim 1 wherein the vibration source means includes a solenoid drive.

4. The system of claim 1 wherein the hopper floor is fixed at the near end and is driven by the vibration source means at the far end.

5. The system of claim 4 wherein the hopper floor is composed of a set of rails.

6. A method for use in a system for feeding and transporting documents, each document having a leading edge and a trailing edge, the system including a feeder stage including a hopper assembly and a feeder wherein the feeder acts to feed documents singly, in order, from a stack of documents in the hopper assembly, the hopper assembly including a hopper floor having a near end at the feeder and a far end away from the feeder, the hopper floor carrying the document stack, and the hopper assembly further including a flag providing a force to move the documents along the hopper floor toward the feeder and to feed a document with a presentation force, wherein the force provided by the flag urges the document stack in a direction from the hopper floor far end toward the hopper floor near end, the system further including a transport stage downstream of the feeder stage for receiving the fed documents, the method comprising:

vibrating the hopper floor such that hopper floor vibration is stronger at the far end with the hopper floor vibration diminishing along the direction from the hopper floor far end toward the hopper floor near end such that the vibration is weaker at the near end to cause a dynamic weight of the document stack to be reduced through vibration, particularly at the hopper floor far end when the document stack is large, so as to reduce variation in the presentation force at the feeder, wherein the hopper floor is composed of a set of rails that are sufficiently stiff so as to vibrate in only one bending mode.

* * * * *